US005207633A

United States Patent [19]

Granger

[11] Patent Number: 5,207,633

[45] Date of Patent: May 4, 1993

[54] APPARATUS TO DISPENSE DISCRETE PORTIONS OF CORRUGATED WIPING MATERIALS

[76] Inventor: Maurice Granger, 17 Rue Marcel Pagnol, 42270 Saint Priest en Jarez, France

[21] Appl. No.: 888,381

[22] Filed: May 22, 1992

Related U.S. Application Data

[63] Continuation of Ser. No. 487,198, Mar. 1, 1990, abandoned.

[30] Foreign Application Priority Data

Mar. 3, 1989 [FR] France ..... 89 03417

[51] Int. Cl.[5] ..... B31F 1/00

[52] U.S. Cl. ..... 493/357; 493/448

[58] Field of Search ..... 493/356–357, 493/439–440, 443, 448; 242/55.18, 55.2; 312/34, 37–41

[56] References Cited

U.S. PATENT DOCUMENTS 1,324,019 12/1919 Ariuchi ..... 242/55.2
3,642,336 2/1972 Harvey, Sr. ..... 312/37
5,013,291 5/1991 Granger ..... 493/357
5,147,279 9/1992 Granger ..... 493/448

FOREIGN PATENT DOCUMENTS 1100244 2/1961 Fed. Rep. of Germany ..... 312/37
2630417 10/1989 France .
2632292 12/1989 France .
2122970 1/1984 United Kingdom ..... 242/55.2

*Primary Examiner*—Bruce M. Kisliuk
*Assistant Examiner*—John A. Marlott
*Attorney, Agent, or Firm*—Eric P. Schellin

[57] ABSTRACT

The unit to dispense wiping materials stored in roll or Z-folded form and delivered in the form of concertina-folded strips is outstanding in that it is fitted with a dampening device (N) the active part of which is arranged so as to periodically have an effect on the tension of the strip between the storage point of the roll and the return and forming means (H) and automatically form, after every dispensing operation of a folded strip by pulling the projecting strip and rotating the roll of material, a loop (b) of unrolled material which is taken up when the next strip is pulled thus preventing any undue tearing of the material.

4 Claims, 2 Drawing Sheets

FIG. 2
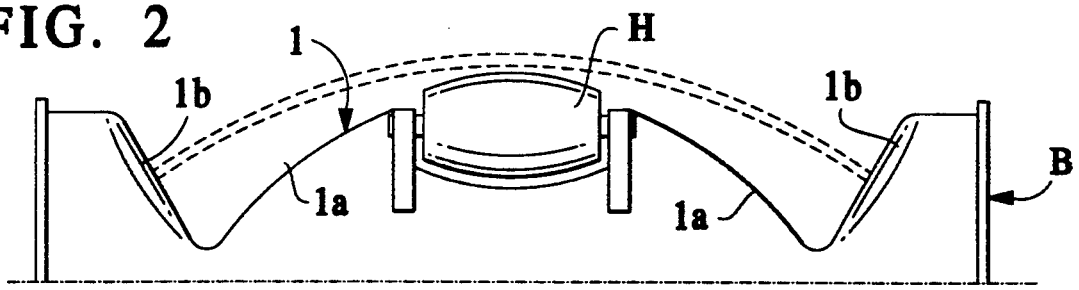
FIG. 3
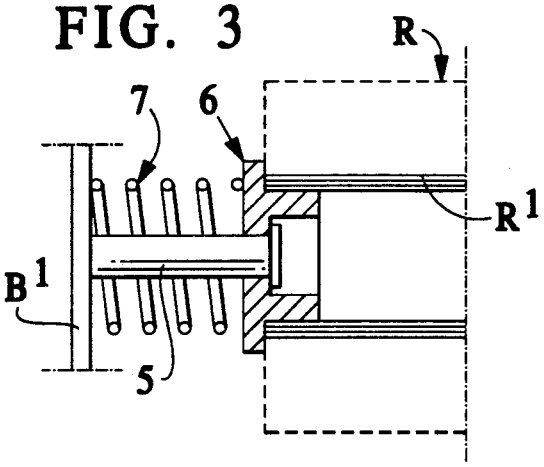
FIG. 4
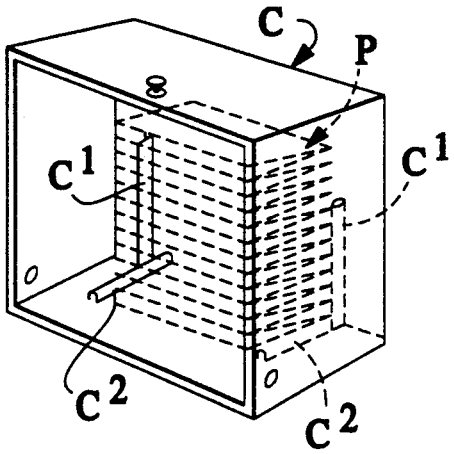
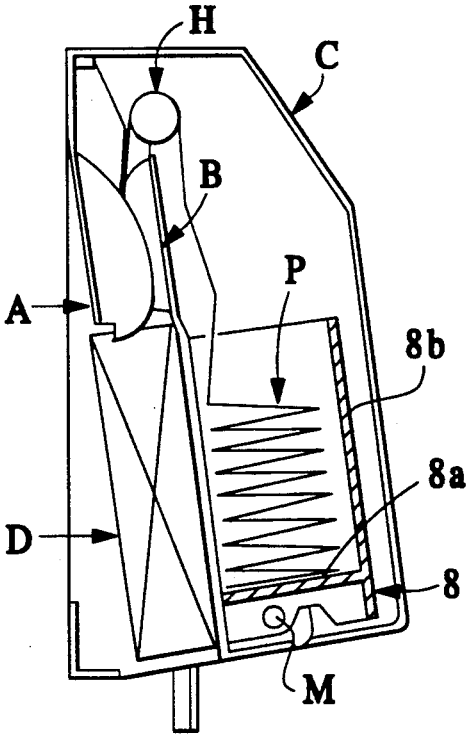
FIG. 5
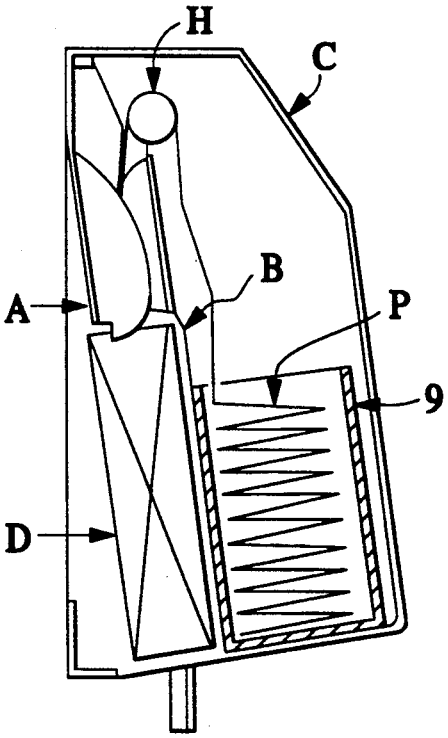
FIG. 6

APPARATUS TO DISPENSE DISCRETE PORTIONS OF CORRUGATED WIPING MATERIALS

This application is a continuation, of application Ser. No. 07/487,198, filed Mar. 1, 1990, now abandoned.

The invention relates to a unit to dispense wiping materials stored in roll form or folded in Z form and delivered in the form of concertina-folded strips.

The object of the invention relates to means to dispense wiping materials of such material as paper, cotton wool, non-woven or other types.

CROSS-REFERENCES TO RELATED APPLICATIONS

The present invention is an improvement of the invention disclosed in copending application Ser. No. 07/224,408 filed: Jul. 26, 1988 now U.S. Pat. No: 5,013,291 and the division thereof Ser. No. 07/641,723 filed: Jan. 15, 1991 now U.S. Pat. No. 5,147,279. These applications claim priority of French patent applications 8805939 and 8807823. The subject matter of said U.S. patent applications and said French patent applications are incorporated in their entireties by reference.

BACKGROUND OF THE INVENTION

According to the application Nos. 8805939 and 8807823, the applicant of which is also the holder, a unit was proposed to automatically dispense lengths of wiping materials loaded in the unit in the form of a roll and delivered in the form of concerntina-folded strips so as to be very resistant to the manual pulling force on the part projecting from the end when the user has wet hands. The said folded strip, due to components suitably positioned between a return and forming means of the unrolled strip and the driving and cutting devices, goes back to its original or practically original form naturally in order to offer a sufficient wiping surface.

Despite everything, with certain types of materials, sudden or reckless pulling on the projecting strip, may tear the material before the cut which risks jamming the unit.

SUMMARY OF THE INVENTION

In order to overcome this and according to a first characteristic of the invention, the unit is fitted with a dampening device whose active part is arranged so as to have an effect over the tension of the strip between the storage point of the roll and the return and forming means, and automatically form, after every dispensing operation of the folded strip, by pulling the projecting part and by rotating the roll of material, a loop of unrolled material which is taken up when the next strip is pulled thus avoiding any undue tearing of the delivered material by sudden pulling. According to another characteristic, the dampening device is made up of a bow hinged on the fixed walls of the unit and elastically returned against the roll support, the transversal part of the said bow having a return means for the unrolled strip facilitating the sliding and forming of the loop when the projecting strip is pulled manually. Another characteristic is found in the fact that in order to check the size of the loop formed by the dampening device in a more precise manner, the rotation of the roll of material is slowed down on its support. With this in mind and according to another characteristic, the roll support, which is fixed to part of the unit hinged on the fixing part with a working surface, is made up of two side end pieces which can be inserted into the mandrel of the roll by a sideways movement with respect to two bolts fixed to the walls of the hinged part, against coil springs suitably calibrated in order to brake the roll accordingly.

For this type of unit, comprising on the part hinged to the fixing part, some return and forming means for the strip unrolled from its support, it was also desired to improve the sliding and forming of the said strip before it passed between the folding components arranged in a complementary manner on the said fixed and hinged parts.

With this in mind and according to another characteristic, the top face of the hinged part which takes the return means in its middle part, has, either side of the said means, a shape in the arc of a circle extending laterally and towards the bottom with a slope substantially up to the middle part, the top face being profiled in a convex manner at least at the level of the slopes in order to improve the sliding of the strip thus guided and formed.

In order to improve the loading and passage of the strip between the folding, driving and cutting means, a special arrangement of extended folding projections made in a complementary manner on the fixed and hinged parts of the unit has been provided. With this in mind and according to other characteristics, the said projections are fixed so as to be adjusted in height with respect to their support, in order to be constantly as close as possible to drive means, or are interchangeable in order to adapt their position with respect to the diameter of the pairs of toothed drive wheels, or self-orientating in order to facilitate the passage of the strip of material, or are made of a flexible, deformable material in a solid or alveolar form.

It was also desired to use materials stored in Z-form with this unit. In this case, it is necessary to provide a means of storage for the pile instead of the roll support and dampening device. With this in mind, several solutions can be envisaged within the scope of the invention.

For example and according to other characteristics, the casing of the unit housing both the fixed and hinged parts, is designed either directly or in a built up manner in order to take and guide the pile or a swivelling and interchangeable container is fixed to the side walls of the hinged part, or the packaging of the pile is provided to be housed between the casing the hinged part.

These characteristics and others will be made apparent from the following description.

BRIEF DESCRIPTION OF THE DRAWINGS

In order to clarify the object of the invention, however, without limiting it, the accompanying drawings have been provided, in which:

FIG. 2 is a partial front view illustrating the arrangement of the top face of the hinged part of the unit.

FIG. 3 is a section illustrating the braked rotating assembly of the roll of material.

FIG. 4 is a perspective view illustrating a casing fitted with receiving and guiding means for a pile of Z-type folded material.

FIG. 5 is a partial section illustrating a receiving and guiding container for a pile of Z-type folded material.

FIG. 6 is a schematic section showing the pile of material folded in Z-form in the unit.

DETAILED DESCRIPTION OF THE INVENTION

Figure 1:
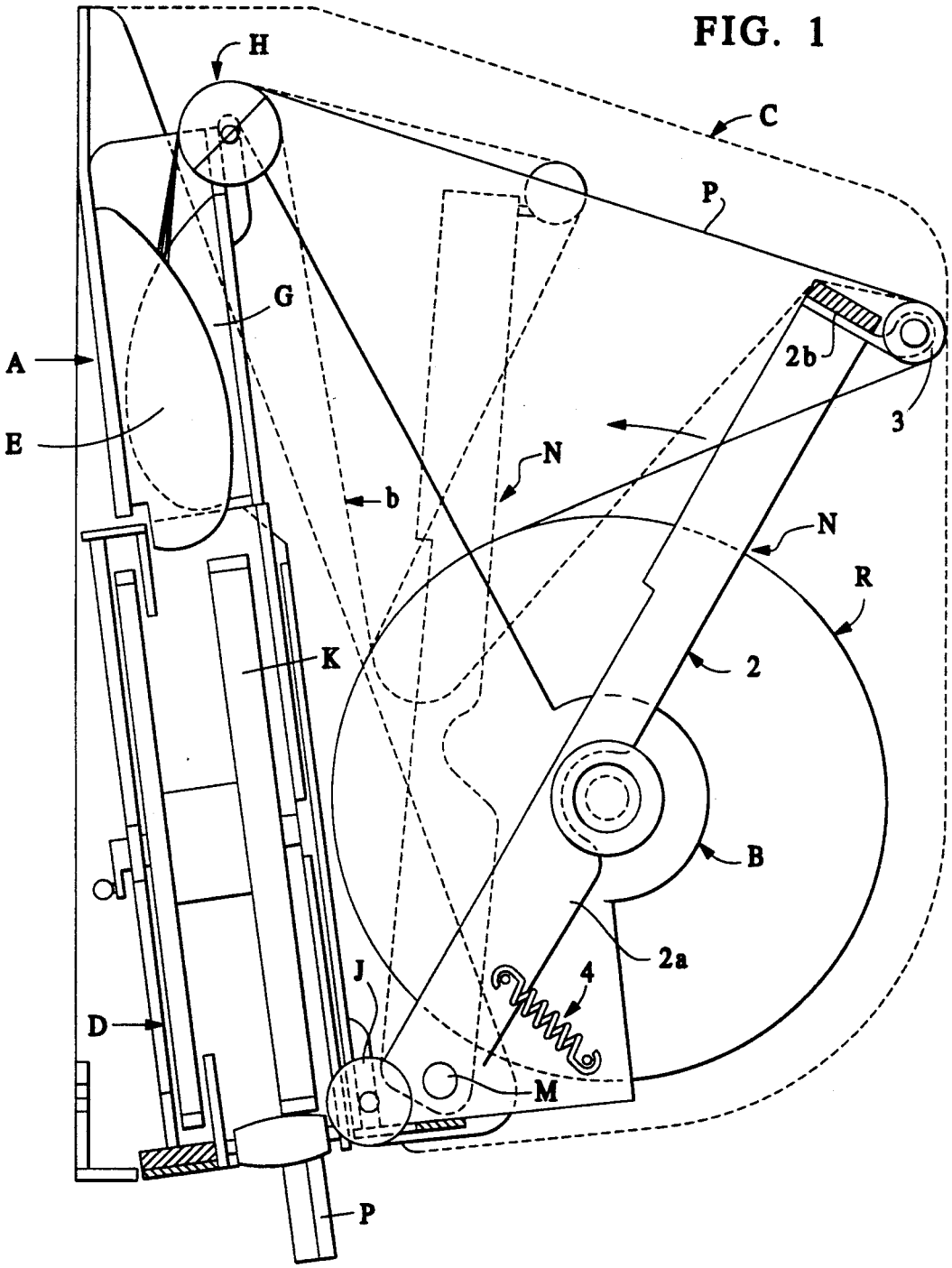
FIG. 1 is a side, sectional view illustrating a unit fitted with a dampening device according to the invention shown in solid lines in the idle position after loading and dashes in the loop forming position.

The object of the invention will become more apparent from the following non limitating description when considered in conjunction with the accompanying drawings.

The unit illustrated in FIG. 1 is of the type corresponding to that of applications 8805939 and 8807823, i.e. it is mainly formed of a lose part (A) having end walls to be fixed to any surface, a paper carrying means part (B) hinged at the bottom end with respect to part (A) and a casing (C) also hinged to part (A), for example, on the same axes (M).

The bottom part of part (A) is designed to take the driving and cutting device (D) for the folded material which is preferably assembled in the form of an interchangeable cassette, especially to offer different lengths of cut material. Close to the top end of part (A), there are extended projections (E) spaced and converging towards one another at the bottom part, whereas similar projections (G) are made in the same way on part (B) to provide concertina type folding of the unrolled strip passing between these interpenetrating projections. The top end of part (B) has a return component for the strip which can be made up of an idle barrel shaped shaft (H) to centre and preform the unrolled strip. At the bottom end, the part (B) is cut out at the centre to allow a roller (J) to pass facilitating the sliding of the folded strip inserted between toothed wheels (K) to feed and rotate the strip.

According to one of the characteristics of the invention, the top face (1) of part (B), is in the shape of an arc of a circle (1*a*) on either side of the return component (H), extending laterally and towards the bottom with a slope (1*b*) substantially up to the level of the component (H) thus making up a guide for the unrolled strip. In order for it to be easier for the said strip to slide, the profile of the said top face has a convex cross section at least the level of the slopes. According to another important characteristic, the unit is fitted with a shock absorber (N) preventing any undue tearing of the wiping material due to sudden manual pulling.

For this purpose, a bow (2) hinged by its side legs (2*a*) on the end walls of part (A) is provided, preferably on the bolts (M). The transversal leg (2*b*) has at least in the middle part, a rotary shaft (3) to return the strip unrolled from its storage roll (R) in the loading direction indicated. This shaft may be cylindrical or barrel shaped like component (H). The bow is urged by two springs (4) fixed to the side walls (B1) of part (B) in order to keep it applied against the mounting bolts of the roll of material.

Therefore, as shown in FIG. 1, after the roll has been loaded, when the folded strip projecting from the unit is pulled, the bow (2), under the effect of the pulling, swivels towards the rear by an angle proportional to the pulling force. After the strip has been cut, cancelling the pull on the strip, the bow, returned by its springs, goes back to the front abutting position and its shaft (3) pulls on the material forcing the roll (R) to turn in the unrolling direction. By sliding due to the pulling speed, the strip is unrolled a bit more and a loop appears between the shaft (3) and shaft (H). At the time of the new pulling action, the loop thus formed, is reduced when the bow is moved to the rear again, the roll (R) is rotated and when the bow returns, a new loop is formed. This way, even when there is a sudden pull on the projecting strip, there is no excessive tension at the roll of material and therefore no undue tearing of the strip.

In order to check the formation of the dampening loop more precisely, it is anticipated for the roll of material to be mounted in a braked manner. For example, as illustrated in FIG. 3, the two side walls (B1) have a bolt (5) on which a shouldered end piece (6) can slide and turn in order to mount and centre the mandrel (R1) of the roll. A coil spring (7) suitably calibrated, is placed between the wall (B1) and shoulder of the end piece to brake the unrolling action of the roll and enable the said roll to be quickly and easily mounted, by a thrust on the end pieces.

Folding, driving and cutting tests made with the unit according to the previous applications, have brought up some problems. In particular, when drive means (K) of different diameters (interchangeable cassettes) have been fitted or the distance between the projections (E and G) and the said means (K) is varied, this can be harmful to the satisfactory operation, particularly for the loading, folding and driving.

For this purpose, different ways of making the projections (E and G) have been planned. For example, they cab be fixed so as to be easily interchangeable in order for them to be constantly arranged as close to the drive means as possible. All the projections except the end ones, can be fixed in a self-orientating manner with limited oscillation to make it easier for the material to pass. They can also be made out of a flexible, deformable material and in solid or alveolar form.

As indicated in the foreword, with this type of unit, it is possible to use strips of material folded in Z-form. In this case, the pile of said material must be supported and guided upstream from the return and forming components arranged instead of the roll support and bow which is no longer required as the strip folded in Z-form acts as a tension dampener. In order to overcome this problem of storing the pile, several solutions can be envisaged.

For example, as illustrated in FIG. 4, the casing (C) can either directly or in a built up manner, have side guides (C1) and possible internal supports (C2) for the pile (P) which is arranged horizontally by tipping towards the front of the casing. According to FIG. 5, a container (8) is hinged on the bolts (M) to also take by forward tipping, the pile (P) on a bottom (8*a*) and against a front wall (8*b*).

In FIG. 6, a packaging (9) containing the pile of material folded in Z-form is provided to be housed between the casing (C) and hinged part (B). The advantages are made clearly apparent from the description, the following is highlighted in particular: the reliability of the unit the dampening device of which enables all types of wiping materials to be dispensed without any risk of tearing before the cutting operation provided.

I claim:

1. An apparatus for manually dispensing web wiping material in the form of elongated discrete strips, comprising a support base means for attaching to a surface, a hood means, said support base means and said hood means defining a housing means, a support mounted internally of said housing means having spaced interleaved projection guide means adapted and constructed to corrugate said web wiping material when it is payed therebetween, supply means for said wiping material, web wiping material spring loaded carrying means hingedly mounted at one end thereof to said support base means, first roller means mounted at the opposite end of said web wiping material carrying means whereby the web wiping material is payed from said supply means over said first roller means, second roller means mounted intermediate said first roller means and said spaced interleaved projection guide means whereby said first roller means moves arcuately in the direction of said second roller means when said web wiping material is manually dispensed and is spring urged arcuately in an opposite direction when said web wiping material has been freed, said second roller means having a barrel configuration and having guide ramps at each end thereof whereby the web material being payed over it defines an arc, a cartridge means mounted on said support base means internally of said housing means adapted and constructed to guide and cut discrete portions of said corrugated web wiping material.

2. The apparatus according to claim 1 wherein the supply means includes a rotatable spool means on which the web wiping material is wound and the spool means has a braking means whereby to limit the rotation of the spool means to thereby pay out a length of said web wiping material when an end portion of said web wiping material is manually pulled.

3. The apparatus of claim 1 wherein the spaced interleaved projection guide means are in confluence in the direction of said cartridge means.

4. The apparatus of claim 3 wherein the said spaced interleaved projection guide means are constructed of resilient materials whereby they are flexible and deformable.

* * * * *